US005741131A

United States Patent [19]

DeGeorge et al.

[11] Patent Number: 5,741,131

[45] Date of Patent: Apr. 21, 1998

[54] STACKING SYSTEM FOR SUBSTRATES

[75] Inventors: Joseph Paul DeGeorge, Wappingers Falls; Kurt Elmer Bastian, Poughkeepsie, both of N.Y.; Michael Alan Cohn, Ramsey, N.J.; Christopher Neal Collins, Poughkeepsie, N.Y.; Italo DiNunzio, Yonkers, N.Y.; Ryan Wayne Wuthrich, Fishkill, N.Y.

[73] Assignee: International Business Machines Corporation, Armonk, N.Y.

[21] Appl. No.: 594,206

[22] Filed: Jan. 31, 1996

[51] Int. Cl.[6] ..... F27D 5/00

[52] U.S. Cl. ..... 432/258; 264/607; 264/608

[58] Field of Search ..... 264/57, 58, 607, 264/608; 432/258, 259

[56] References Cited

U.S. PATENT DOCUMENTS

| | | | |
|---|---|---|---|
| 1,186,490 | 6/1916 | Moorcroft | 432/258 |
| 2,738,564 | 3/1956 | Guinane | 432/258 |
| 3,988,107 | 10/1976 | Koch | 432/258 |
| 5,130,067 | 7/1992 | Flaitz | 432/258 |
| 5,336,453 | 8/1994 | Giller | 264/57 |

FOREIGN PATENT DOCUMENTS

| | | | |
|---|---|---|---|
| 239448 | 9/1925 | United Kingdom | 432/258 |

*Primary Examiner*—James Derrington

*Attorney, Agent, or Firm*—Steven J. Soucar; Ira D. Blecker

[57] ABSTRACT

A stacking system includes a frame having recesses therein used to partially define openings that permit gas generated during firing of a substrate within the space defined by the frame to escape without adversely affecting the substrate. A relatively thin tile placed on the frame provides the system with an additional level for substrates.

8 Claims, 4 Drawing Sheets

STACKING SYSTEM FOR SUBSTRATES

TECHNICAL FIELD

This invention generally relates to a stacking system for substrates that are to be fired at an elevated temperature. More particularly, the invention relates to a stacking system having a frame whose height varies along its perimeter to define openings therein.

BACKGROUND OF THE INVENTION

Integrated circuit chips are mounted on ceramic substrates. During the manufacturing process, a single layer of substrates is placed on a relatively large, e.g., 18×18 inch, thick, e.g., 8 mm, molybdenum plate, which in turn is placed in a moving "walking beam" furnace. The substrates are then fired at an elevated temperature in the furnace. The output of fired substrates is limited by the number of substrates that can be placed on the plate. Multiple spacers can be used to permit stacking of a second plate thereon. A third plate can be stacked on top of the second plate using multiple spacers. The stacked arrangement increases output and is referred to as a "boat". The following shortcomings are associated with boats. The thick plates are expensive but are required because thinner plates warp and sag at the elevated temperature. The thickness of the plates limits the number of layers (since the height of the stack obviously cannot be greater than that of the furnace). The weight of the plate also requires spacers that have a relatively large footprint which consumes space that could otherwise be used for substrates. The numerous individual spacers are time consuming to position and prone to shifting and falling which can result in the supported plate falling which in turn damages the substrates and the furnace.

Containment wires are used to prevent substrates from sliding off the plate as the boat moves through the furnace. It is time consuming to put the containment wires in place and their cost increases the cost of the boat.

A system that permits substrates to be stacked which does not exhibit the above shortcomings is highly desirable.

SUMMARY OF THE INVENTION

The invention provides an efficient, relatively inexpensive system for stacking substrates to be fired at an elevated temperature to increase the output of fired substrates. The system includes a frame having a height that varies along its perimeter to define openings therein. The openings permit gas generated by a substrate within a space defined by the frame to escape the space without adversely effecting the substrate.

Numerous other advantages and features of the present invention will become readily apparent from the following detailed description of the preferred embodiments and the appended claims.

DETAILED DESCRIPTION OF THE PREFERRED EMBODIMENTS

Figure 1:
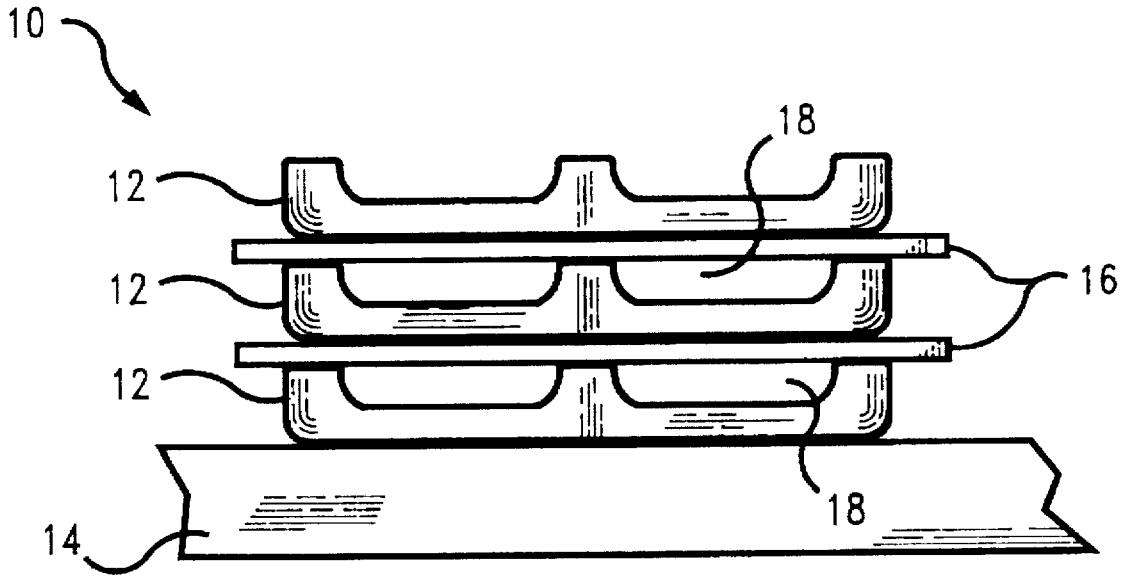
FIG. 1 is a side elevational view of a stacking system of the present invention.

FIG. 1 illustrates a stacking system 10 of the present system that provides multiple levels for holding substrates (not shown) to be fired at an elevated temperature to increase the output of a furnace (not shown). The substrates preferably are used in the manufacture of integrated circuit chip packages. The system 10 includes at least one frame 12. The frame 12 rests on a base 14. Tiles 16 are between, and supported in a substantially level position by, the frames 12. The base 14 is preferably conventional and has dimensions that are much greater than those of the tiles 16. For example, a conventional base 14 is about 18 inches×18 inches×8 mm whereas the tile 16 is about 9 inches×9 inches×2.5 mm. Openings 18 are defined by each frame 12 and the tile 16 that is supported thereby. In a further embodiment that is not illustrated, openings are formed by the frame and the base.

Figure 2:
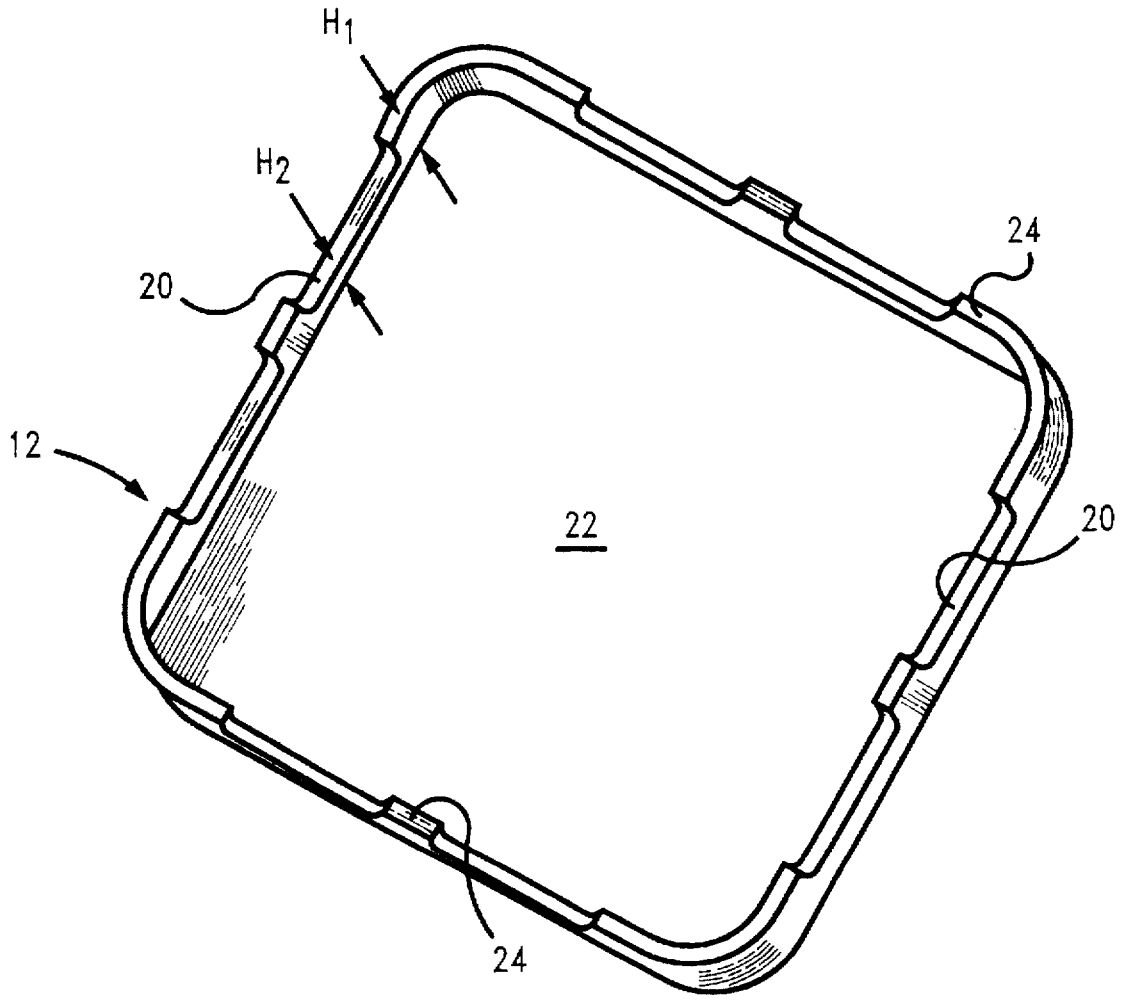
FIG. 2 is a perspective view of a frame of the stacking system.

FIG. 2 illustrates the frame 12 in greater detail. The height of the frame varies along its perimeter as indicated by $H_1$ which is greater than $H_2$. The variation in height creates recesses 20 that form part of the openings. The recesses 20 are designed, i.e., are deep, wide and frequent enough, so that gas generated during the firing of the substrates can escape from within a space 22 defined by the frame 12. The spacing and uniformity of height of ridges 24 contributes to the frame 12 supporting the tile in a substantially level position. The frame 12 is preferably contiguous about its entire perimeter. As is readily apparent, the design of the frame 12 permits it to be easily positioned on the base and imparts stability which makes the frame 12 easier to position and more stable than individual spacers.

Figure 3:
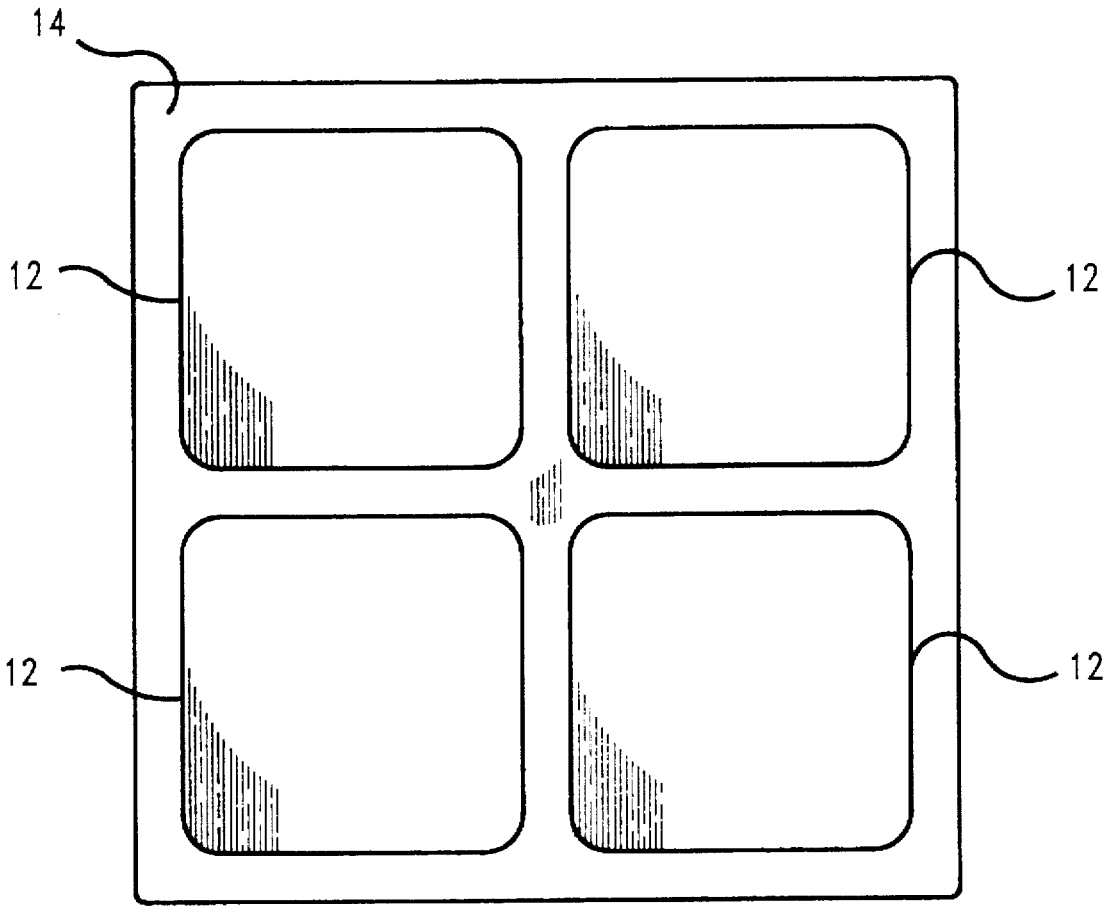
FIG. 3 is a top elevational view of a base having frames of the present invention thereon.

FIG. 3 schematically illustrates an embodiment wherein four frames 12 are on the base 14. A tile (not shown) is placed on each frame 12 after the substrates (not shown) are placed on the base 14. Each tile can receive thereon additional frames and tiles to increase the number of levels of tiles available to receive substrates. The use of multiple frames 12 on a single base 14 and a distinct tile for each frame 12 imparts important advantages to the system. The thickness of the tiles can be reduced because each tile has less distance it must span; as compared to a tile that must span the entire base 14. Having a thin tile on each frame 12 does not result in physical distortion of the tiles at the elevated temperatures experienced during firing. If a thin tile was used to span the entire base 14, the tile would be physically distorted. When the tile is physically distorted the substrates on the tile can also be distorted because they do not sit flat on the tile during firing.

Figure 4:
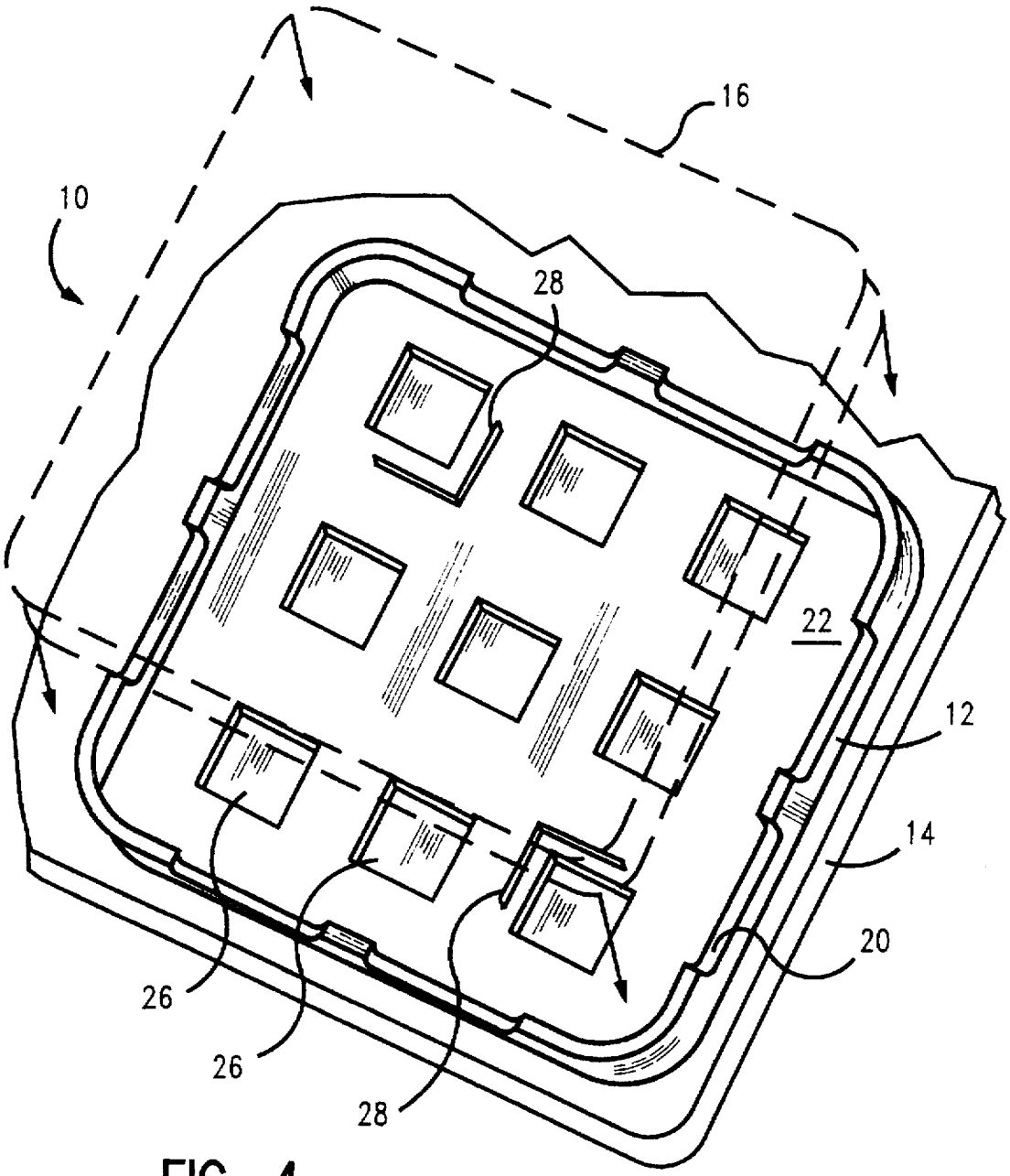
FIG. 4 is a perspective view of one frame on the base with a tile positioned over the frame.

FIG. 4 illustrates a single frame 12 on the base 14. A typical procedure to fire substrates 26 involves placing the frame 12 on the base 14, placing the substrates 26 on the base 14, placing supports 28 on the base 14 and placing the tile 16 on top of the frame 12 and supports 28. The substrates 26 can then be fired. If desired, the tile 16 can receive thereon a second frame, additional substrates, a second set of supports and a second tile (none of which are shown). The supports 28 are illustrated as having a truncated L shape; albeit other shapes can be used provided the design permits gas generated during the firing of the substrates to escape from the interior frame space 22. That is, the design of the supports 26 cannot permit gas to become trapped within the space 22 defined by the frame 12. The supports 28 are illustrated as being free standing; albeit a support(s) that extends from the frame 12 can also used if it keeps the tile substantially level and permits the gas to escape.

The invention is also directed to a method of firing substrates, especially substrates for integrated circuits, that includes the steps of providing the base, a first frame and at least one substrate, positioning the substrate on the base within the space defined by the frame and firing the substrate. The method can also include the steps, performed before the first substrate is fired, of providing a first tile on the frame, positioning a second substrate within a second frame on the first tile and firing the second substrate. Additional tiles, frames and substrates can be assembled in like fashion.

The stacking system creates multiple levels for substrates using the frame which is easy to position, stable and designed to permit gas generated within the space defined by the frame to escape without adversely affecting the substrates being fired. When multiple frames are used on the base and a tile is used on each frame, relatively thin tiles can be used instead of an additional thick base. The use of the thin tiles saves money without adversely affecting the substrates and still permits additional frames and tiles to be placed thereon to increase the number of levels of the system that can receive substrates. The frames help retain the substrates in position and inhibit them from sliding off without the need for containment wires.

It presently is theorized that the above-described advantages are achieved because of the design to the stacking system. It also is theorized that the method contributes to obtaining the advantages.

The stacking system is particularly suited for increasing the output of a furnace used to fire ceramic substrates used in the manufacture of integrated circuit chips.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

We claim:

1. A system for stacking substrates to be fired at an elevated temperature, the system comprising:

a) a base;

b) a tile;

c) a frame circumscribing a space that rests on and within the perimeter of the base upon which the tile rests so as to separate the base and tile from each other, the frame having a height that varies along its perimeter to define recesses and a center support on each side of the frame that permit gas generated by a substrate within the space defined by the frame to escape the space without adversely affecting the substrate, the frame being capable of supporting the tile in a substantially level position; and d) a support within the perimeter of the frame that is also capable of supporting the tile in a substantially level position.

2. The system of claim 1 wherein the support is a free standing support.

3. The system of claim 1 wherein the support is a pair of supports having a truncated L shape.

4. The system of claim 1 wherein the base is thicker than the tile.

5. The system of claim 1 wherein the dimensions of the base are greater than those of the tile.

6. The system of claim 1 wherein the frame is contiguous about the entire perimeter.

7. The system of claim 1 wherein the frame is a first frame and the tile is a first tile and further comprising a second frame, the second frame resting on the first tile, the second frame having a height that varies along its perimeter to define recesses in the second frame that permit gas generated by a substrate within a space defined by the second frame to escape the second frame space without adversely affecting the substrate.

8. The system of claim 7 further comprising a second tile that rests on the second frame and a third frame that rests on the second tile, the third frame having a height that varies along its perimeter to define recesses in the third frame that permit gas generated by a substrate within a space defined by the third frame to escape the third frame space without adversely affecting the substrate.

* * * * *